US011148776B2

(12) United States Patent
Skrzypchak et al.

(10) Patent No.: US 11,148,776 B2
(45) Date of Patent: Oct. 19, 2021

(54) TILLER SYSTEM FOR A MARINE OUTBOARD ENGINE

(71) Applicant: BRP US INC., Sturtevant, WI (US)

(72) Inventors: Mark J. Skrzypchak, Pleasant Prairie, WI (US); Kenneth Chung, Lindenhurst, IL (US)

(73) Assignee: BRP US INC.

( * ) Notice: Subject to any disclaimer, the term of this patent is extended or adjusted under 35 U.S.C. 154(b) by 0 days.

(21) Appl. No.: 16/685,169

(22) Filed: Nov. 15, 2019

(65) Prior Publication Data

US 2020/0156751 A1 May 21, 2020

Related U.S. Application Data

(60) Provisional application No. 62/768,293, filed on Nov. 16, 2018.

(51) Int. Cl.
*B63H 20/12* (2006.01)
*B63H 20/06* (2006.01)

(52) U.S. Cl.
CPC ..... *B63H 20/12* (2013.01); *B63H 20/06* (2013.01)

(58) Field of Classification Search
CPC ..... B63H 20/12; B63H 20/06
See application file for complete search history.

(56) References Cited

U.S. PATENT DOCUMENTS

| | | | | |
|---|---|---|---|---|
| 4,496,326 | A | 1/1985 | Boda | |
| 6,715,438 | B1 | 4/2004 | Hundertmark | |
| 6,902,450 | B2 * | 6/2005 | Ohtsuki | B63H 20/12 440/63 |
| 7,325,507 | B1 | 2/2008 | Hundertmark | |
| 8,007,330 | B2 | 8/2011 | Wong et al. | |
| 10,723,429 | B1 * | 7/2020 | Wiatrowski | B63H 20/12 |
| 2005/0016779 | A1 * | 1/2005 | Lindsay | B62B 3/0612 180/19.3 |
| 2018/0001987 | A1 * | 1/2018 | Biebach | B63J 3/04 |

* cited by examiner

*Primary Examiner* — Stephen P Avila
(74) *Attorney, Agent, or Firm* — BCF LLP

(57) ABSTRACT

A tiller system for a marine outboard engine having a tiller bracket is described. The tiller system comprises a tiller for mounting to the tiller bracket. A speed input control is mounted to the tiller and a speed input control position sensor detects a position of the speed input control. A control unit is mounted to the tiller and is operatively connected to the speed input control position sensor. The control unit converts the position of the speed input control into a speed input message. A digital communication port of the control unit transmits the speed input message to the marine outboard engine over a controller area network bus. A marine outboard engine having the tiller system and a marine outboard engine system for a watercraft are also described.

18 Claims, 9 Drawing Sheets

TILLER SYSTEM FOR A MARINE OUTBOARD ENGINE

CROSS-REFERENCE

The present application claims priority from U.S. Provisional Patent Application No. 62/768,293, filed Nov. 16, 2018, the entirety of which is incorporated herein by reference.

TECHNICAL FIELD

The present technology relates to tiller system for a marine outboard engines.

BACKGROUND

Conventional tiller systems communicate with outboard engines mechanically, via push-pull cables and/or via standard analog electrical interfaces using, for example, a multi wire system (MWS).

Connectors directly mounted on marine outboard engine systems, usually underneath a cowling that protects the engine, provide engine fault codes that may be read by service personnel for maintenance and diagnostic purposes. To this end, it is usually required to reach over the transom of a boat and to remove the cowling to get access to the connector.

There is therefore a desire for a connectivity solution that addresses the above issues.

SUMMARY

It is an object of the present technology to ameliorate at least some of the inconveniences present in the prior art.

According to one aspect of the present technology, there is provided a tiller system for a marine outboard engine having a tiller bracket, the tiller system comprising: a tiller adapted for mounting to the tiller bracket; a speed input control mounted to the tiller; a speed input control position sensor adapted for detecting a position of the speed input control; and a control unit mounted to the tiller and operatively connected to the speed input control position sensor, the control unit being adapted for converting the position of the speed input control into a speed input message, the control unit comprising a digital communication port adapted for transmitting the speed input message to the marine outboard engine over a controller area network (CAN) bus.

In some implementations, the digital communication port is further adapted for receiving, from the marine outboard engine over the CAN bus, a message carrying an operational parameter of the marine outboard engine.

In some implementations, the digital communication port is a first digital communication port; and the control unit further comprises a second digital communication port adapted for outputting information related to the marine outboard engine over the CAN bus, the information being based at least in part on the operational parameter of the marine outboard engine.

In some implementations, the second digital communication port is a diagnostic port.

In some implementations, the first and second digital communication ports are interchangeable.

In some implementations, the CAN bus supports a standard protocol.

In some implementations, the standard protocol is a National Marine Electronics Association (NMEA) 2000 protocol.

In some implementations, the first communication port is adapted for using the standard protocol to control an operation of the marine outboard engine; and the second communication port is adapted for using the standard protocol to output the information.

In some implementations, the information is selected from a run/stop status of the marine outboard engine, an on/off status of an engine management module for the marine outboard engine, a rotational speed of the marine outboard engine, a temperature of the marine outboard engine, a transmission gear of the marine outboard engine, a battery voltage of the marine outboard engine, a tilt/trim position of the marine outboard engine, a fault code of the marine outboard engine, a low oil message, a lack of oil message, a fuel level, a coolant temperature, an engine overheat message, a check engine message, and any combination thereof.

In some implementations, the tiller system includes a first cable connected to the first digital communication port for providing a connection of the first digital communication port to the marine outboard engine; and a second cable connected to the second digital communication port, the second cable being adapted for selectively providing a connection between the marine outboard engine and the external device.

In some implementations, the second cable is connectable to a device selected from a gauge, a chart plotter, a digital display device, a tachometer, an engine diagnostic device, and a combination thereof.

In some implementations, the first and second communication ports and the control unit are positioned within a recess of the tiller.

In some implementations, the tiller system includes a door mounted to the tiller and adapted for selectively providing access to the recess of the tiller and for allowing extraction of an end of the second cable from the recess.

In some implementations, the tiller system includes a grommet mounted to the tiller and providing a passage for running the first cable to allow for its connection to the marine outboard engine.

In some implementations, the tiller system includes a rigging bundle adapted for receiving the first cable between the grommet and the marine outboard engine.

In some implementations, the tiller system includes a third cable connected to a third digital communication port of the control unit for providing a connection of the third digital communication port to the marine outboard engine.

In some implementations, the third digital communication port is further adapted for communicating a wake-up message to the marine outboard engine.

In some implementations, the CAN bus is a first CAN bus and the third communication port is further adapted for communicating with the marine outboard engine using a proprietary protocol over a second CAN bus.

In some implementations, the tiller system includes a first power cable having a first power connector at one end for connection to a battery of the marine outboard engine, another end of the first power cable being connected to a first power port of the control unit; a second power cable being connected at one end to a second power port of the control unit, another end of the second power cable having a second power connector adapted for attachment to an auxiliary device; and a switch controlled by the control unit and adapted for establishing an electrical connection between the first and second power ports.

In some implementations, the digital communication port is further adapted for receiving, from the marine outboard engine over the CAN bus, a message carrying an operational parameter of the marine outboard engine, the control unit controlling the switch when the control unit detects, based on the operational parameter of the marine outboard engine, that the marine outboard engine is running.

In some implementations, the tiller system includes a wire harness adapted for connecting the speed input control position sensor to the control unit.

In some implementations, the tiller system includes a gear shift control mounted to the tiller; and a gear shift control position sensor adapted for detecting a position of the gear shift control; the wire harness being further adapted for connecting the gear shift control position sensor to the control unit; the control unit being further adapted for converting the position of the gear shift control into a gear shift control message; and the digital communication port being further adapted for transmitting the gear shift control message to the marine outboard engine over the CAN bus.

In some implementations, the tiller system includes an operator-actuated start/stop switch mounted to the tiller; the wire harness being further adapted for connecting the start/stop switch to the control unit; the control unit being further adapted for converting a state of the start/stop switch into a start/stop message; and the digital communication port being further adapted for transmitting the start/stop message to the marine outboard engine over the CAN bus.

In some implementations, the tiller system includes an operator-actuated cut-off switch mounted to the tiller; the wire harness being further adapted for connecting the cut-off switch to the control unit; the control unit being further adapted for converting a state of the cut-off switch into a cut-off message; and the digital communication port being further adapted for transmitting the cut-off message to the marine outboard engine over the CAN bus.

In some implementations, the tiller system includes an operator-actuated tilt/trim control switch mounted to the tiller; the wire harness being further adapted for connecting the tilt/trim control switch to the control unit; the control unit being further adapted for converting a state of the tilt/trim control switch into a tilt/trim adjustment message; and the digital communication port being further adapted for transmitting the trim adjustment message to the marine outboard engine over the CAN bus.

In some implementations, the tiller system includes an operator-actuated touch troll button mounted to the tiller; the wire harness being further adapted for connecting the touch troll button to the control unit; the control unit being further adapted for converting a state of the touch troll button into a touch troll message; and the digital communication port being further adapted for transmitting the touch troll message to the marine outboard engine over the CAN bus.

In some implementations, the tiller system includes an operator-actuated key switch mounted to the tiller; the wire harness being further adapted for connecting the key switch to the control unit; the control unit being further adapted for converting a state of the key switch into a wake-up message; and the digital communication port being further adapted for transmitting the wake-up message to the marine outboard engine over the CAN bus.

In some implementations, the tiller system includes a display device mounted to the tiller; the digital communication port is further adapted for receiving from the marine outboard engine a status message over the CAN bus; and the control unit is further adapted for converting the status message into a status to be displayed by the display device.

According to another aspect of the present technology, there is provided a marine outboard engine system for a watercraft, comprising: an engine assembly, comprising: an engine, a gear case, a driveshaft operatively connected at a first end to the engine and operatively connected at an opposite second end to the gear case, a propeller shaft driven by the engine via the driveshaft and the gear case, a propeller mounted to the propeller shaft, and an engine management module adapted for controlling the engine; the marine outboard engine system further comprising: a bracket assembly adapted for connecting the engine assembly to the watercraft; a tiller bracket mounted to the engine assembly; and a tiller system comprising: a tiller adapted for mounting to the tiller bracket; a speed input control mounted to the tiller; a speed input control position sensor adapted for detecting a position of the speed input control; and a control unit mounted to the tiller and operatively connected to the speed input control position sensor, the control unit being adapted for converting the position of the speed input control into a speed input message, the control unit comprising a digital communication port adapted for transmitting the speed input message to the marine outboard engine over a controller area network (CAN) bus mounted to the tiller bracket, the digital communication port communicating with the engine management module.

For purposes of this application, terms related to spatial orientation such as forward, rearward, upward, downward, left, and right, should be understood in a frame of reference where the propeller position corresponds to a rear of the marine outboard engine. Terms related to spatial orientation when describing or referring to components or sub-assemblies of the marine outboard engine separately from the marine outboard engine should be understood as they would be understood when these components or sub-assemblies are mounted to the marine outboard engine, unless specified otherwise in this application.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology introduces the use of digital control, for example using a controller area network (CAN) bus, to transmit messages that reflect commands applied by an operator on a tiller system to a digitally controlled marine outboard engine.

A tiller includes a control unit that converts operator inputs, for example a speed input control (e.g. a throttle control), as well as shift, trim and engine start/stop controls detected by sensors, into digital messages that are communicated to an engine management module over a CAN bus, using a National Marine Electronics Association (NMEA) 2000 protocol. The CAN bus may also transmit messages carrying various operational parameters of the engine and of other electronic devices connected to the CAN bus to the tiller for visual or auditory display to the operator.

The tiller system may be provided with an accessory cable, on the same CAN bus, that may be used to access various diagnostic information about the marine outboard engine, for example by outputting engine fault codes. Alternatively, the accessory cable may be used to connect an electronic device, such as a gauge or the like. The accessory cable may be hidden within a recess of the tiller when not in use, becoming accessible by opening a small door on an underside of the tiller, thereby removing the need for reaching over the transom of a boat and to take off the cowling to access a diagnostic connector directly mounted on the engine.

Figure 1:
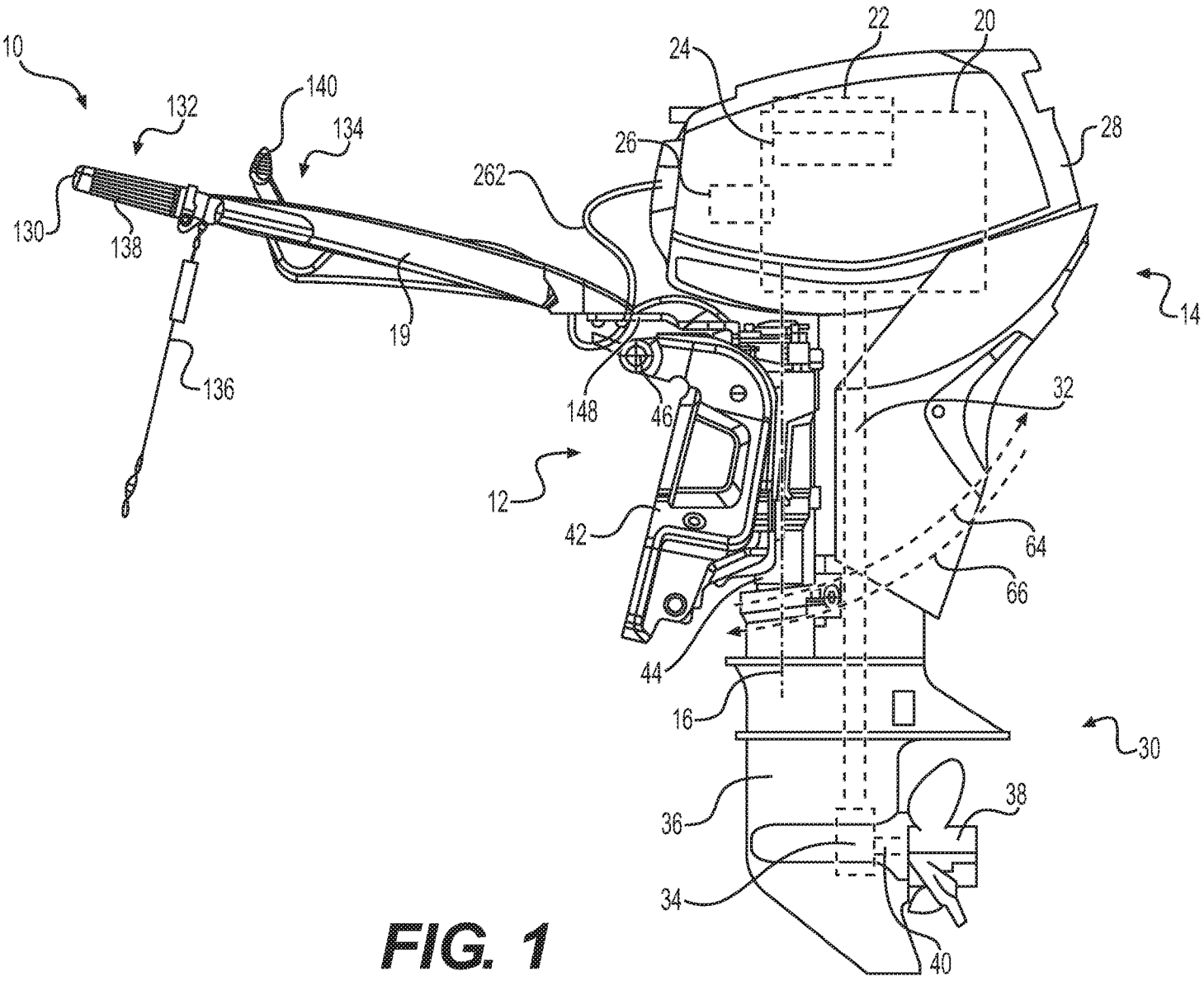
FIG. 1 is a left side elevation view of a marine outboard engine.

With reference to the drawings, FIG. 1 is a left side elevation view of a marine outboard engine. A marine outboard engine 10 includes a bracket assembly 12 for mounting the marine outboard engine 10 to a watercraft, an engine assembly 14 pivotably mounted to the bracket assembly 12 about a steering axis 16, and a power steering system (not shown), operated via a tiller 19, for pivoting the engine assembly 14 about the steering axis 16. The engine assembly 14 is shown in an upright position.

As shown schematically in FIG. 1, the engine assembly 14 includes an engine 20 and a magneto 22 driven by the engine 20. The marine outboard engine 10 further includes a combination of electric and manual starters 24, and an engine management module (EMM) 26. It is contemplated that only a manual starter, or only an electric starter, could be used to start the engine 20.

The engine 20 and the EMM 26 are surrounded and protected by a cowling 28. In the present embodiment, the engine 20 is a two-stroke gasoline powered internal combustion engine 20. It is contemplated that the engine 20 could be any type of engine, including a four-stroke internal combustion engine and/or an electric engine. It is contemplated that various types of the EMM 26 could selected depending on each particular type of engine 20 for example. For example, where the engine 20 is an electric engine, an electric engine management module could be used to control operation of the electric engine and other elements associated with the marine outboard engine 10.

The marine outboard engine 10 further includes a propulsion unit 30. The propulsion unit 30 is connected at a bottom of the engine assembly 14. The propulsion unit 30 includes a driveshaft 32 and a transmission 34. The driveshaft 32 is operatively connected at its upper end to the engine 20 to be driven by the engine 20. The driveshaft 32 extends downward from the engine 20 to the transmission 34 housed in a gear case 36 of the propulsion unit 30. The transmission 34 is connected to the bottom end of the driveshaft 32.

The propulsion unit 30 further includes a propeller 38 supported on a propeller shaft 40. The propeller shaft 40 is rotationally supported at a bottom, rear end of the gear case 36, such that the propeller 38 extends rearward from the propulsion unit 30 for propelling the marine outboard engine 10. The transmission 34 operatively connects the bottom end of the driveshaft 32 to the propeller shaft 40 to selectively drive the propeller 38 to propel the marine outboard engine 10.

The transmission 34 has a forward gear for propelling the marine outboard engine 10 forward, a neutral gear in which the transmission 34 decouples the propeller shaft 40 from the driveshaft 32, and a reverse gear for propelling the marine outboard engine 10 rearward. The gears of the transmission 34 are shifted by an electronic gear shift actuator 35 (schematically shown in FIG. 4) that is operated via the EMM 26. It is contemplated that a different type of transmission 34 could be used, including a mechanically actuated transmission 34, a transmission 34 that has a single forward gear and no other gears, or a transmission 34 that includes forward and neutral gears and no reverse gear. It is also contemplated that a different propulsion unit 30, such as a jet drive for example, could be used.

The bracket assembly 12 of the marine outboard engine 10 includes a stern bracket 42 and a swivel bracket 44 pivotally connected to the stern bracket 42 about a tilt/trim axis 46. The stern bracket 42 is configured for mounting the marine outboard engine 10 to a stern or other part of a watercraft (not shown).

Figure 2:
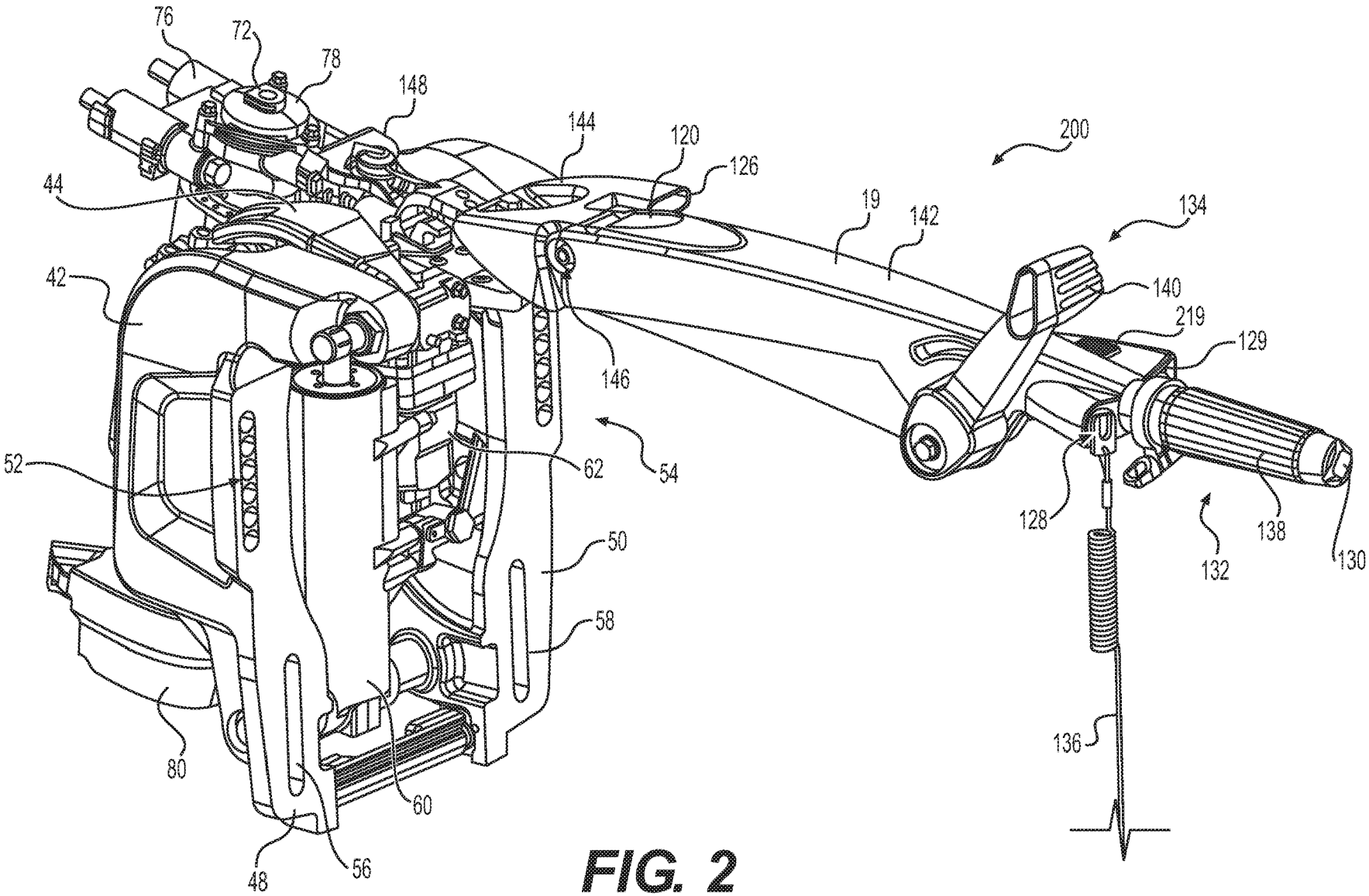
FIG. 2 is a perspective view taken from a front, right, top side of a bracket assembly and a tiller of the marine outboard engine of FIG. 1.

FIG. 2 is a perspective view taken from a front, right, top side of a bracket assembly 12 and a tiller 19 of the marine outboard engine of FIG. 1. The tiller 19 of FIG. 1 is part of a tiller system 200 that is mounted to the marine outboard engine 10. For mounting the marine outboard engine 10 to a watercraft, the stern bracket 42 includes two laterally spaced attachment members 48, 50 that contact the stern or other part of the watercraft when the marine outboard engine 10 is mounted to the stern or the other suitable part. In the present embodiment, two sets of upper mounting apertures 52, 54 and two elongate lower apertures 56, 58 are defined in the attachment members 48, 50. The upper and lower mounting apertures 52, 54, 56, 58 are sized to receive bolts (not shown) therethrough and to allow for upward and downward adjustment of the securement position of the stern bracket 42 relative to the stern or the other suitable part. In the case of attachment to a stern of a watercraft for example, bolts are inserted through the stern and corresponding ones of the apertures 52, 54, 56, 58, and through corresponding apertures in the stern. A nut (not shown) is threaded onto each of the bolts and tightened to a suitable degree to secure the stern bracket 42, and therefore also the marine outboard engine 10, to the stern. It is contemplated that any other mounting mechanism could be used.

Still referring to FIG. 2, a hydraulic tilt/trim piston 60 is pivotably connected at one end to the stern bracket 42 and at the other end to the swivel bracket 44. The tilt/trim piston 60 is fluidly operatively connected to a hydraulic tilt/trim pump 62 mounted to the swivel bracket 44. The tilt/trim pump 62 and a tilt/trim control switch 130 are in electronic communication with the EMM 26. The tilt/trim control switch 130 is disposed on the end of the tiller 19 and is used by an operator of the marine outboard engine 10 to operate the tilt/trim pump 62 to adjust tilt/trim of the engine assembly 14. An upper steering bracket 76 and a steering position sensor 78 are connected to the upper end of a pivot shaft 72 that is coaxial with the steering axis 16. A lower steering bracket 80 is connected to the lower end of the pivot shaft 72 and extends downward from the bottom end of the pivot shaft 72. The lower steering bracket 80 is similarly connected to the engine assembly 14.

The tilt/trim pump 62 adjusts tilt/trim of the engine assembly 14 by selectively extending the tilt/trim piston 60 to pivot the swivel bracket 44 upward 64 relative to the stern bracket 42 about the tilt/trim axis 46 and by retracting the tilt/trim piston 60 to pivot the swivel bracket 44 downward 66 relative to the stern bracket 42 about the tilt/trim axis 46. It is contemplated that any other suitable tilt/trim actuator could be used in addition to or instead of the tilt/trim piston 60.

Referring to FIGS. 1 and 2, the tiller 19 includes a key switch 126, an engine cut-off switch 128, the tilt/trim control switch 130, a speed input control 132 that includes a twist grip 138 pivotably mounted to a front end of the tiller 19, a gear shift control 134 that includes a lever 140 pivotably mounted onto the tiller 19 rearward of the speed input control 132, an engine start/stop switch 129, a touch troll button 219, and a display device 120. The speed input control 132 may be a throttle control when the marine outboard engine 10 is gas engine. The speed input and gear shift controls 132, 134 are mounted to a front portion 142 of the tiller 19 that pivots upward and downward relative to a rear portion 144 of the tiller 19 about a pivot connection 146. It is contemplated that any other speed input and gear shift controls could be used. It is contemplated that in embodiments in which the transmission 34 has only one, forward, gear, the gear shift control 134 could be omitted. It is contemplated that the pivot connection 146 could be omitted, in which case the front and rear portions 142, 144 of the tiller 19 could be fixed relative to each other and/or could be cast integral with each other. In the present embodiment, the display device 120 is a diagnostic light 120 including a light emitting diode (LED) and is operable to shine in a plurality of different colors of light and different on-off light sequences that are visible to an operator of the marine outboard engine 10 in order to provide various informational signals to the operator, although it is contemplated that other types of display devices could be used. The key switch 126 wakes the EMM 26 and the rest of the electrical system of the outboard engine 10. The engine start/stop switch 129 provides power to the electric starter 24. The engine cut-off switch 128 has a lanyard 136 attached thereto. The lanyard 136 is attachable to an operator of the marine outboard engine 10 and shuts off the engine 20 when removed from the engine cut-off switch 128. It is contemplated that a different start-stop and/or safety shut-off systems could be used.

The tiller 19 further includes a tiller bracket 148 that connects the rear portion 144 of the tiller 19 to the upper steering bracket 76 and pivots with the engine assembly 14 about the steering axis 16. It is contemplated that the tiller bracket 148 could mount the tiller 19 directly to the engine assembly 14. As shown in FIG. 1, the tiller bracket 148 extends over the tilt/trim axis 46 when the engine assembly 14 is fully trimmed down.

Figure 3:
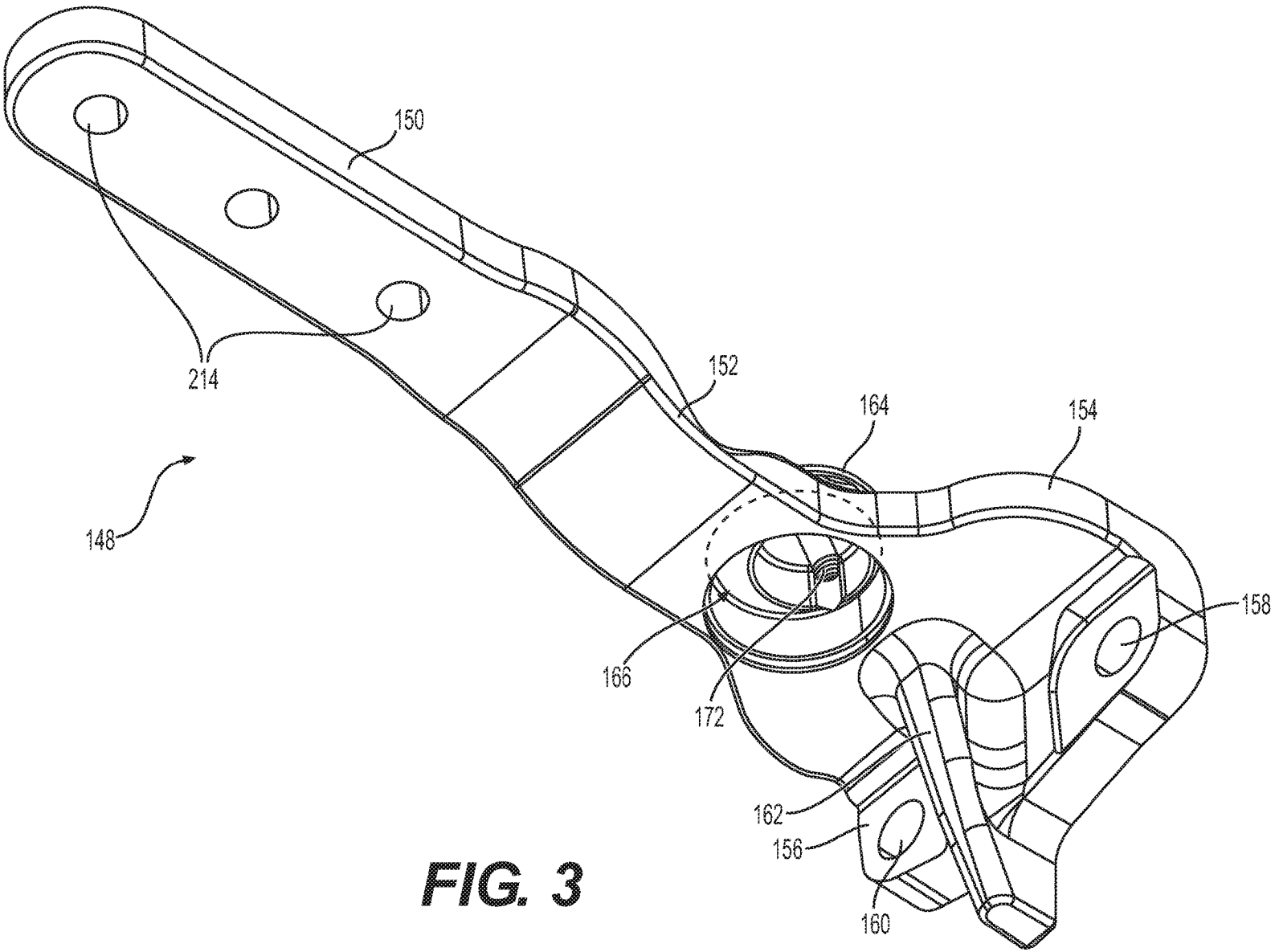
FIG. 3 is a perspective view taken from a front, bottom, left side of the tiller bracket of FIG. 1.
Figure 8:
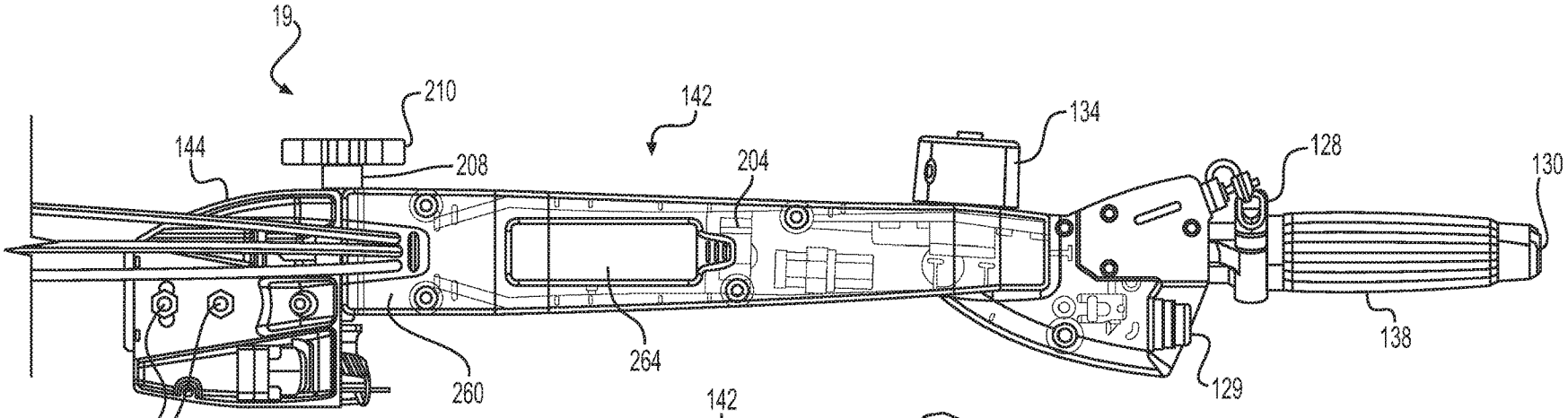
FIG. 8 is a bottom plan view of the tiller of FIG. 5 showing details of an access door for an accessory cable.
Figure 9:
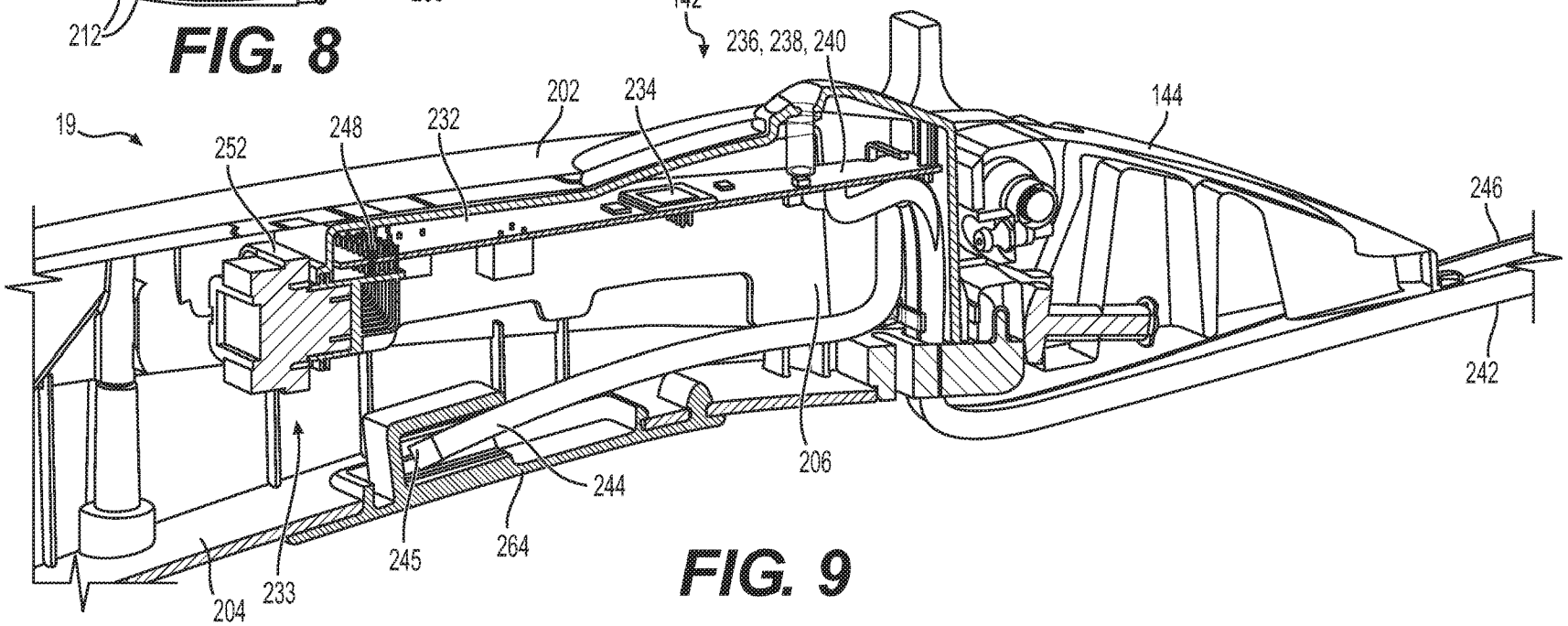
FIG. 9 is partial, cutaway, perspective view taken from a front, left side of the tiller of FIG. 5, showing details of a routing path for the accessory cable according to an embodiment.

FIG. 3 is a perspective view taken from a front, bottom, left side of the tiller bracket 148 of FIG. 1. As shown, the tiller bracket 148 includes an elongate portion 150 that is bolted to the rear end of the tiller 19, a downwardly-arcuate portion 152 extending rearward from the elongate portion 150, and a mounting portion 154 that extends rearward from a rear end of the downwardly-arcuate portion 152. In the present embodiment, the mounting portion 154 of the tiller bracket 148 includes a downwardly-extending mounting plate 156 with two apertures 158, 160 defined therethrough. The mounting portion 154 is bolted to the upper steering bracket 76 with two bolts (not shown) received through corresponding ones of the two apertures 158, 160 and in corresponding threaded apertures defined in a forward facing mating surface of the upper steering bracket 76, which mating surface contacts the mounting portion 154. It is contemplated that a different connection could be used. For example, the tiller bracket 148 could be cast integral with the upper steering bracket 76. The mounting portion 154 includes a longitudinally-extending rib 162 positioned laterally in the middle of the mounting plate 156. A rearward facing surface of the rib 162 abuts and is pressed against the forward facing mating surface of the upper steering bracket 76 when the tiller bracket 148 is bolted to the upper steering bracket 76. The rib 162 adds structural strength to the tiller bracket 148 in a vertical direction. It is contemplated that a different construction of the tiller bracket 148 could be used. For example, it is contemplated that the rib 162 could be omitted. The mounting portion 154 defines a dome-shaped portion 164 extending upward from a top surface of the tiller bracket 148. As best seen in FIGS. 8 and 9, the portion 164 defines a dome-shaped cavity 166 therein. The dome-shaped cavity 166 is open on a bottom side of the tiller bracket 148 and includes an upper dome portion 168 and a lower dome portion 170 that is wider than the upper dome portion 168. A channel 172 is defined through the upper dome portion 168 of the dome-shaped cavity 166 and extends into the dome-shaped cavity 166.

Figure 4:
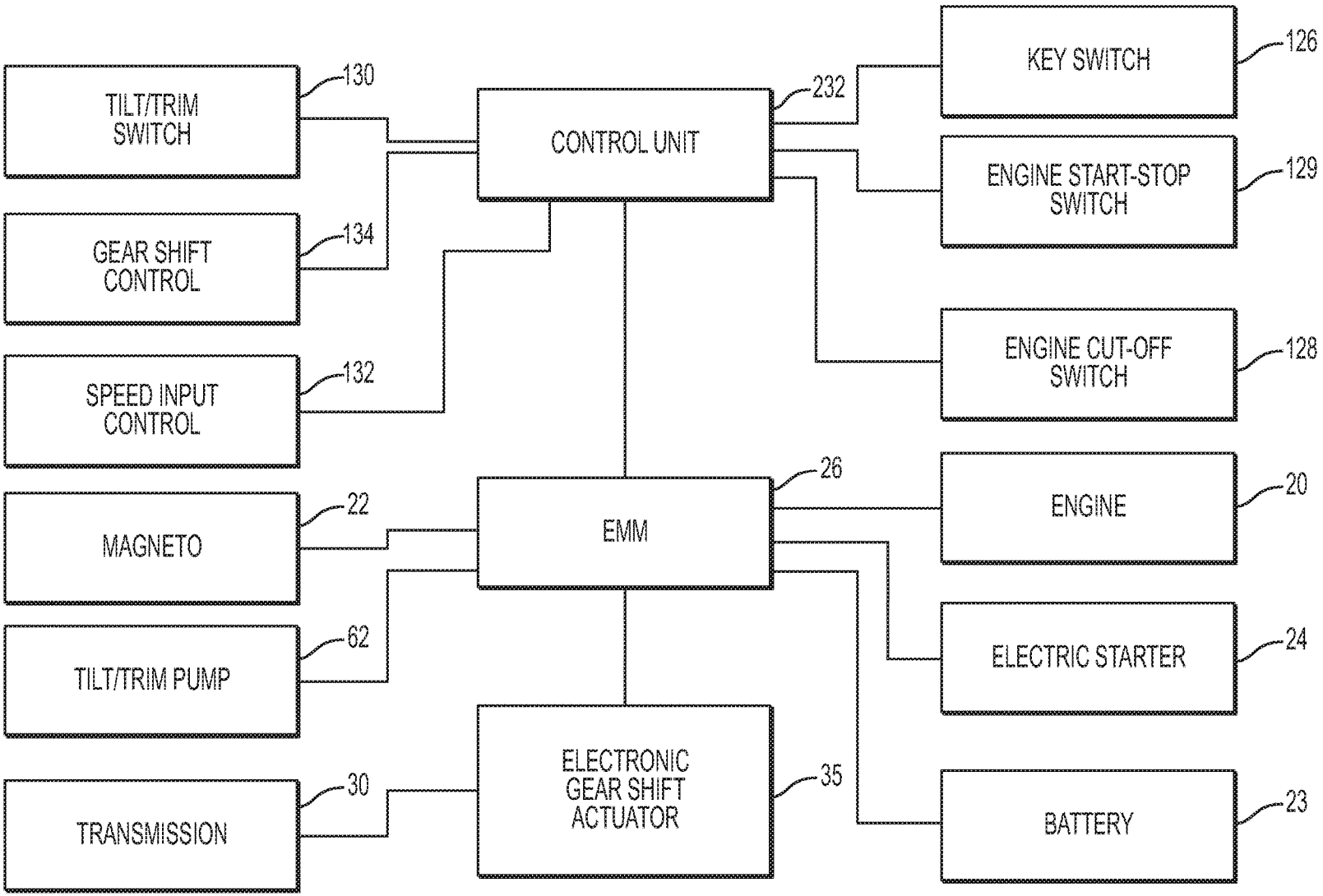
FIG. 4 is a schematic diagram showing electronic connections between a control unit, an engine management module and various components of the marine outboard engine of FIG. 1.
Figure 5:
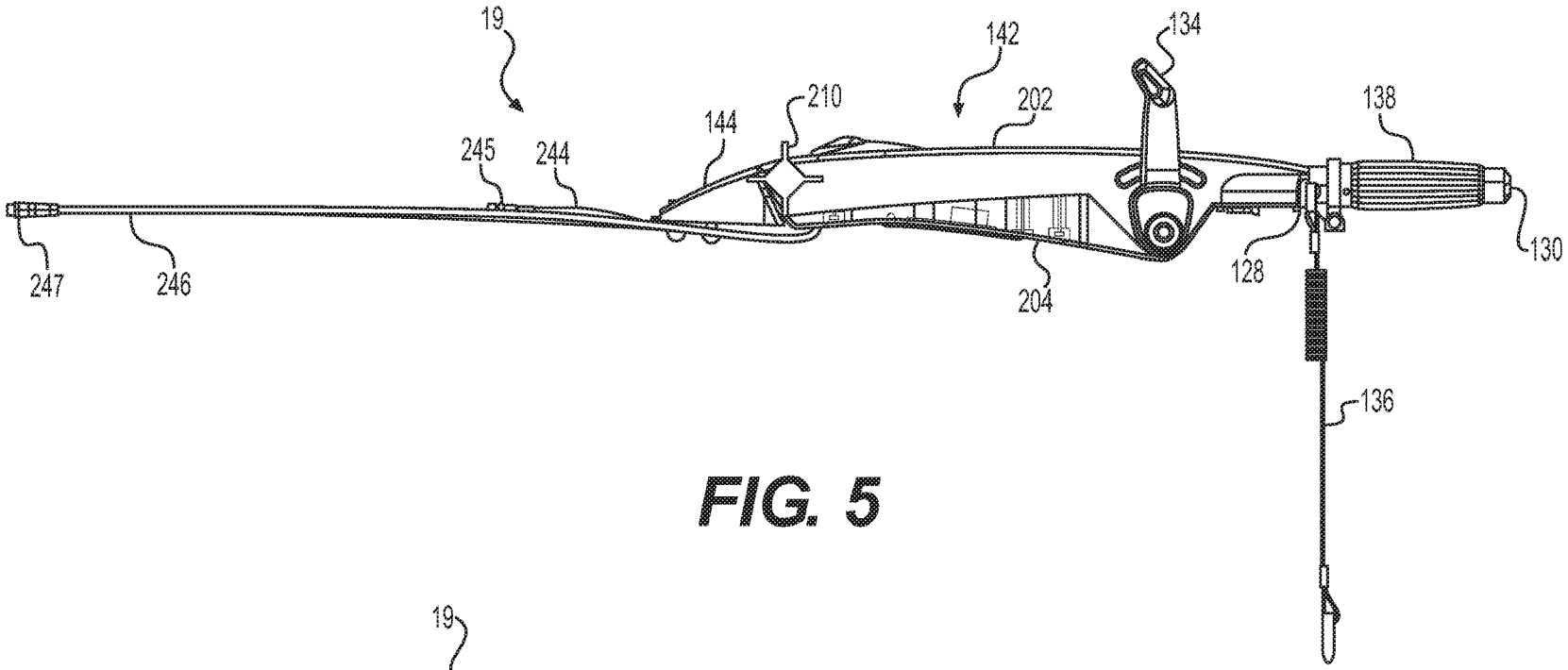
FIG. 5 is a right side elevation view of a tiller having digital communication cables for use with the marine outboard engine of FIG. 1 according to an embodiment.
Figure 6:
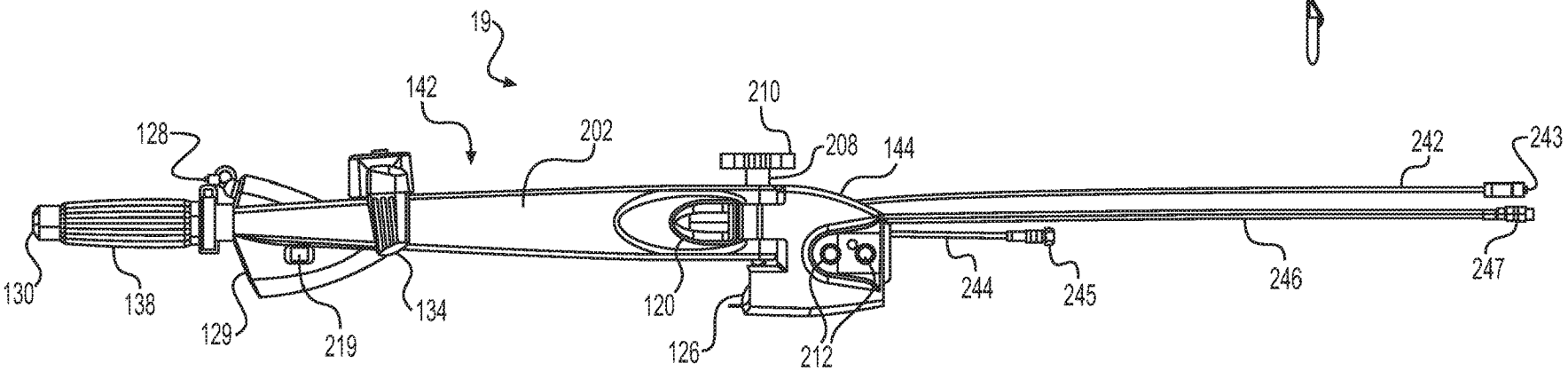
FIG. 6 is a bottom plan view of the tiller of FIG. 5.

FIG. 4 is a schematic diagram showing electronic connections between a control unit 232, an engine management module 26 and various components of the marine outboard engine 10 of FIG. 1. The EMM 26 is electronically connected to the engine 20 and controls operation of the engine 20. The magneto 22 generates a power supply (in the present embodiment, 20 amperes at 55 volts) applied to the EMM 26 to charge a battery 23 that, in turn, is used to run the electric starter 24 to start the engine 20. The magneto 22 also powers the EMM 26 and various accessories and other functions. A power management module within the EMM 26 transforms this power supply into different voltages that power the electronic components of the marine outboard engine 10. It is contemplated that the marine outboard engine 10 could have any other suitable electronic system.

As shown schematically in FIG. 4, the key switch 126 is operatively connected to the EMM 26 via an electronic connection extending to a control unit 232 (see FIGS. 7 and 9) mounted on the tiller 19 and to the EMM 26. The key switch 126 is used by the operator to wake up the EMM 26 itself and other electronic components of the engine assembly 14. The start/stop switch 129 is operatively connected to the electric starter 24 via an electronic connection extending to the control unit 232 and to the EMM 26 for starting the engine 20. The engine cut-off switch 128 is operatively connected to the engine 20 via an electronic connection extending to the control unit 232 and to the EMM 26 for shutting off the engine 20. As may be seen in FIG. 2 for example, the tilt/trim control switch 130 is operatively connected to the tilt/trim pump 62 via an electronic connection extending to the control unit 232 and to the EMM 26 and operates the tilt/trim pump 62 as described hereinabove, by being pressed upward or downward by an operator of the marine outboard engine 10. It is contemplated that a different tilt/trim system control could be used.

The speed input control 132 is operatively connected to the engine 20, via an electronic connection extending to the control unit 232 and to the EMM 26, for adjusting a power output of the engine 20. The gear shift control 134 is operatively connected to the transmission 34, via an electronic connection extending to the control unit 232 and to the EMM 26, for selecting gears of the transmission 34. The control unit 232 receives electronic control signals reflecting positions of the speed input control 132 and of the gear shift control 134. The control unit 232 translates these electronic control signals into messages forwarded to the EMM 26. The EMM 26 controls operations of the engine 20 and of the electronic gear shift actuator 35 of the transmission 34 in response to these messages.

Referring now to FIGS. 5 to 9, the front portion 142 of the tiller 19 includes a cast aluminum upper housing 202 and a molded plastic lower housing 204. The rear portion 144 is made of cast aluminum. The front and rear portions 142, 144 of the tiller 19 as illustrated may pivot about a pivot axis 208 with respect to the rear portion 144. A rotatable knob 210 may be used to frictionally limit the movement of the front 142 portion with respect to the rear portion 144. In a variant, the tiller 19 may be formed of a unitary piece. The rear portion 144 of the tiller 19 is adapted for mounting to the tiller bracket 148 using bolts 212 that are integral to the rear portion 144 and are insertable in openings 214 (FIG. 3) of the tiller bracket 148.

A variety of operator-actuated controls that are mounted to the tiller 19 of the tiller system 200 include the twist grip 138, the tilt/trim control switch 130 located on an extremity of the twist grip 138, a touch troll button 219, the gear shift control 134, the start/stop switch 129, the cut-off switch 128 to which the lanyard 136 may be attached, and the key switch 126 for the EMM 26 of the marine outboard engine 10. The display device 120 adapted for providing diagnostic information received at the tiller system 200 from the EMM 26, for example a low oil indication, a lack of oil indication, a fuel level, a coolant temperature, an engine overheat indication, and a check engine indication. It is also mounted to the tiller 19.

Figure 7:
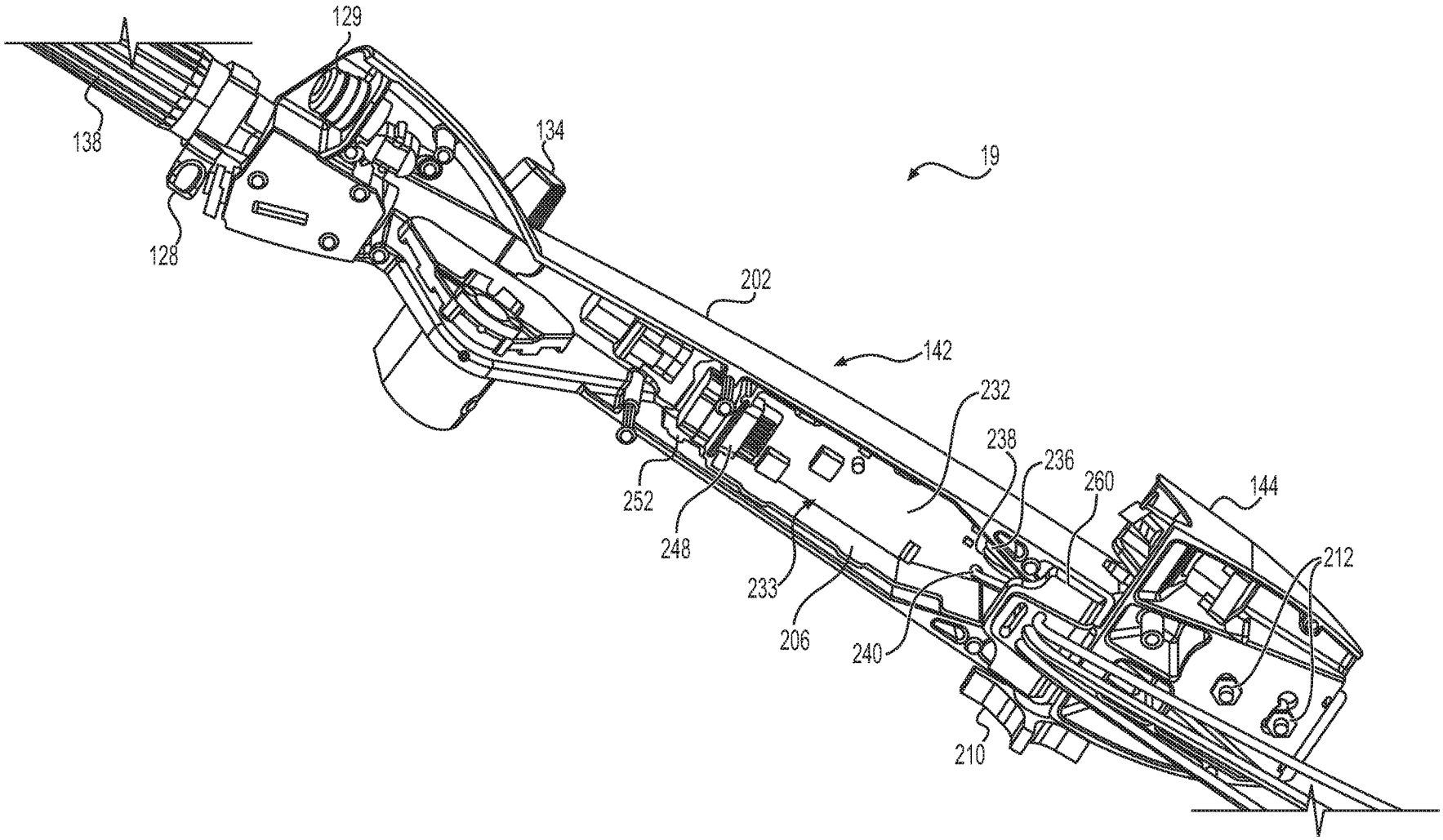
FIG. 7 is a partial perspective view taken from a front, left, bottom side of the tiller of FIG. 5 with the lower housing of the tiller removed for clarity.
Figure 10:
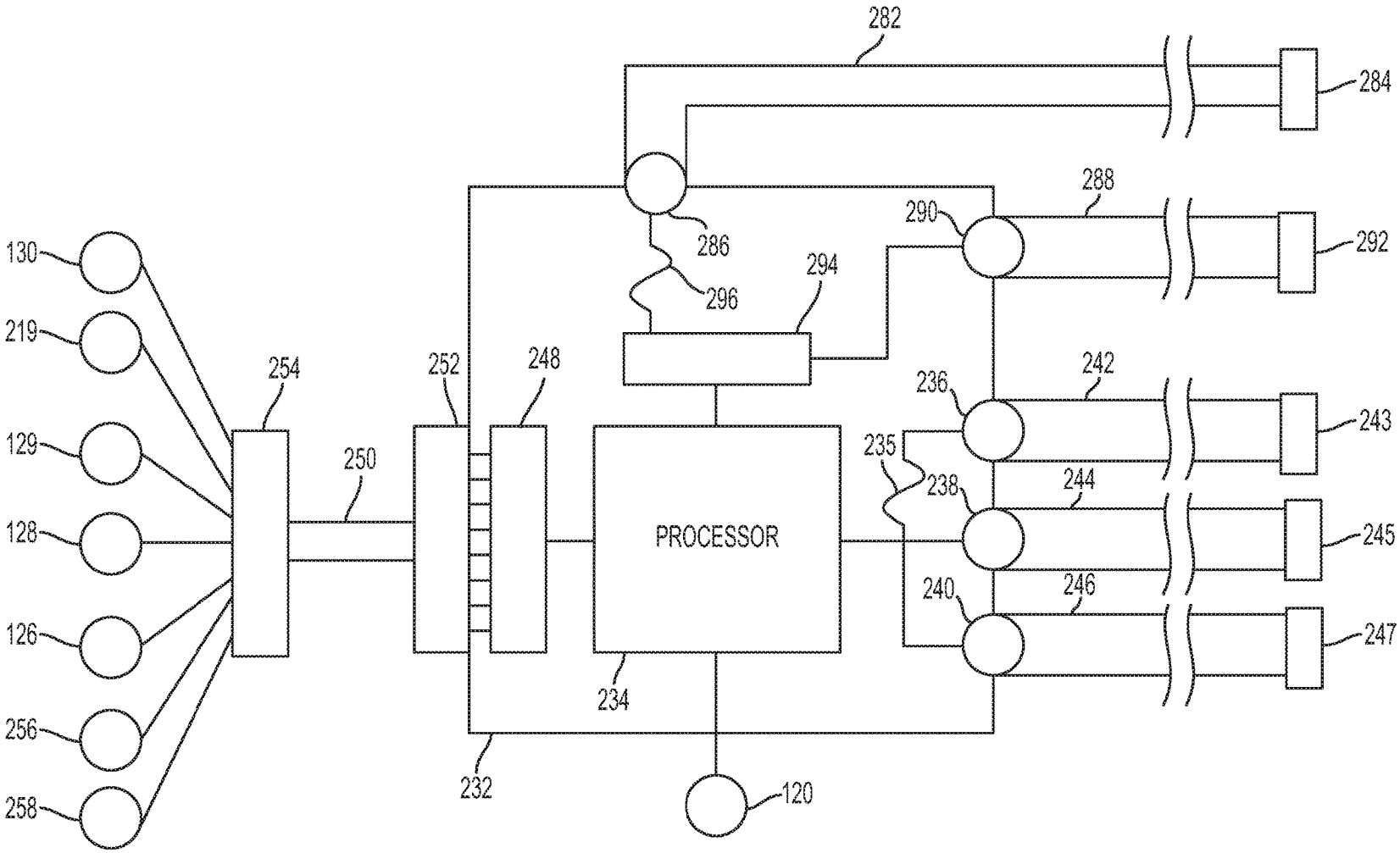
FIG. 10 is a schematic circuit diagram of the control unit introduced in the description of FIG. 4 according to an embodiment.

The control unit 232 is mounted to the tiller 19. As illustrated in FIGS. 7 and 9, the control unit 232 is formed of a printed circuit board (PCB) mounted within a recess 233 of the front portion 142 of the tiller 19, for example being mounted to a main, upper casting 206 internally mounted to the front portion 142 of the tiller 19 as shown on FIG. 9. Details of the control unit 232 are shown on FIG. 10, which is a schematic circuit diagram of the control unit 232 according to an embodiment. Referring now to FIG. 10, the control unit 232 includes a processor 234 operatively connected at one end of the control unit 232 to three (3) digital communication ports 236, 238, 240 that are respectively electrically and communicatively coupled to respective ends of three (3) cables 242, 244 and 246. The cables 242, 244 and 246 respectively terminate at opposite ends at connectors 243, 245 and 247. The cables 242 and 246 have a sufficient length for reaching the cowling 28 of the marine outboard engine 10. The cable 244 is shorter in the present embodiment, being intended for use as an accessory cable 244 for connection to various devices embarked in the watercraft. In an embodiment, the digital communication port 238 is a diagnostic port and the accessory cable 244 is a diagnostic cable 244. The digital communication ports 236, 238 and 240 as well as the cables 242, 244 and 246 may follow a CAN bus vehicular standard for transmitting data in a digital format. The digital communication ports 236 and 238 as well as the cables 242 and 244 are all on the same CAN bus. The digital communication ports 236 and 238 are interchangeable and mainly differ by their intended usage. The digital communication port 240 and the cable 246 are on a distinct and separate CAN bus.

In an embodiment, the digital communication port 236 communicates with the marine outboard engine 10 via the cable 242 using an industry standard (or public) protocol, for example and without limitation, the NMEA 2000 protocol, and the CAN bus that connects digital communication ports 236 and 238 as well as the cables 242 and 244 to the EMM 26 is a public CAN bus. In this embodiment, the digital communication port 238 also outputs the diagnostic information to the accessory cable 244 using the industry standard protocol. In the same or another embodiment, the voltage from the battery 23 of the marine outboard engine 10 may also be routed via the fuse 235 to the accessory cable 244 to provide electrical power to an external device connected thereto.

At an opposite end of the control unit 232, the processor is electrically connected to a multi-pin connector 248 on which a wire harness 250 is connected via a connector 252. Another connector 254 located at an opposite end of the wire harness 250 provides electrical connections to the start/stop switch 129 (for cranking the engine), to the cut-off switch 128 (engine off), to the tilt/trim control switch 130, to the touch troll button 219 (fine RPM control), to a speed input control position sensor 256 adapted for detecting a position of the speed input control 132, for example an angular position of the twist grip 138, and to a gear shift control position sensor 258 adapted for detecting a position of the gear shift control 134. The display device 120 has a separate connection to the processor 234. Without limitation, the speed input control position sensor 256 may for example be an angular position sensor operatively connected to the speed input control 132 and the gear shift control position sensor 258 may for example be an angular position sensor operatively connected to the gear shift control 134. The speed input control position sensor 256 and the gear shift control position sensor 258 translate positions of the speed input and shift mechanisms into varying electrical signals. These signals and other signals from the start/stop switch 129, the cut-off switch 128, the tilt/trim control switch 130 and the touch troll button 219 are provided to the processor 234 of the control unit 232 via the connectors 254 and 248 and via the wire harness 250. The processor 234 converts these signals into messages that are transmitted on the public CAN bus that connects the control unit 232 to the EMM 26 via the digital communication port 236 and the cable 242. In a reverse direction, the processor 234 of the control unit 232 may control illumination of the display device 120 to display various statuses of the marine outboard engine 10, these statuses being identified in status messages received on the public CAN bus at the processor 234 from the EMM 26.

A voltage from the battery 23 of the marine outboard engine 10 is received at the control unit 232 via a pin of the digital communication port 236. The control unit 232 may be protected by a fuse 235, for example a 10-ampere fuse. The digital communication port 236 communicates with the EMM 26 of the marine outboard engine 10 via the cable 242 having its connector 243 operatively connected to the EMM 26 via a rigging assembly (not shown) of the marine outboard engine 10. The cable 242 transmits at least the position of the speed input control 132 as sensed by the speed input control position sensor 256. Other parameters received at the control unit 232, including any one of the position of the gear shift control 134, a state of the tilt/trim control switch 130, a state of the touch troll button 219, a state of the start/stop switch 129 and a state of the cut-off switch 128, may also be transmitted to the EMM 26 by the digital communication port 238. The digital communication port 236 is adapted for receiving, from the EMM 26, information including one or more operational parameters of the marine outboard engine 10.

The digital communication port 238 is adapted for outputting, via the accessory cable 244, all messages on the CAN bus and in particular information based at least in part on the one or more operational parameters of the marine outboard engine 10. In an embodiment, any message received at the control unit 232 from the EMM 26 and present at the digital communication port 236 is also present on the digital communication port 238 and on the accessory cable 244.

Non-limiting examples of information elements that may be provided in messages received from the EMM 26 at the digital communication port 236 include a run/stop status of the marine outboard engine 10, an on/off status of the EMM 26, a rotational speed of the marine outboard engine 10, a temperature of the marine outboard engine 10, a selected transmission gear of the marine outboard engine 10, a battery voltage of the marine outboard engine 10, a tilt/trim position of the marine outboard engine 10, a fault code of the marine outboard engine 10, a low oil message, a lack of oil message, a fuel level, a coolant temperature, an engine overheat message, a check engine message, and any combination thereof. Without limitation, the information that may be outputted from the digital communication port 238 via the accessory cable 244 may include diagnostic information based in whole or in part on the operational parameters of the marine outboard engine 10. The diagnostic information may for example comprise the same information in the format as received by the control unit 232 on the digital communication port 236.

The digital communication port 240 provides redundancy to the features of the digital communication port 236. Consequently, the digital communication port 240 is adapted for transmitting messages representing at least the position of the speed input control 132 as sensed by the speed input control position sensor 256 to EMM 26 of the marine outboard engine 10, via the cable 246 having its connector 247 operatively connected to the EMM 26 26 via the rigging assembly of the marine outboard engine 10. so that the EMM 26 may control a power output of the marine outboard engine 10. Other parameters received at the control unit 232, including any one of the position of the gear shift control 134, a state of the tilt/trim control switch 130, a state of the touch troll button 219 a state of the start/stop switch 129 and a state of the cut-off switch 128, may also be transmitted in messages sent to the marine outboard engine 10 by the digital communication port 238.

In an embodiment, the digital communication port 240 communicates with the marine outboard engine 10 via the cable 246 using a proprietary (or private) protocol configured for a specific embodiment of the EMM 26 and the CAN bus that connects digital communication port 240 as well as the cable 246 to the EMM 26 is a private CAN bus. Using the proprietary protocol, the digital communication port 240 may for example forward a wake-up message toward the EMM 26 of the marine outboard engine 10. This wake-up message, which is separate from and usually precedes a start (crank) message, allows the EMM 26 to provide battery power to the various electronic components of the marine outboard engine 10, including for example the public and private CAN busses and the control unit 232.

In an embodiment, the connector 243 of the cable 242 that connects the digital communication port 236 to the EMM 26 on the public CAN bus and the connector 245 of the accessory cable 244 that connects the digital communication port 238 to an external device on the public CAN bus both have a configuration having five (5) terminals and may transmit data at a 250 kbps rate. The connector 247 of the cable 246 that connects the digital communication port 240 to the EMM 26 on the private CAN bus has a configuration having six (6) terminals allowing its connection to various electronic devices, for example marine instruments. The private CAN bus supports a 125 kbps rate. The proprietary CAN bus has a fault tolerant design, based on an International Standards Organization (ISO) 11898-3 standard that defines CAN for road vehicles.

Still referring to FIG. 10, a separate circuit may be used to provide power from the battery 23 to an auxiliary device. The separate circuit comprises a first power cable 282 having a connector 284 connected to the battery 23 at one end and another end of the first power cable 282 being connected to a first power port 286 on the control unit 232. The separate circuit also comprises a second power cable 288 connected at one end to a second power port 290 on the control unit 232 and to a power connector 292 for attachment to an auxiliary device at another end. The power connector 292 may for example be a Deutsch™ connector. A switch 294 controlled by the processor 234 connects the first power port 286 to the second power port 290 when the marine outboard engine 10 is running. In order to prevent draining the battery 23, the processor 234 causes the switch 294 to disconnect the first power port 286 from the second power port 290 when the marine outboard engine 10 is stopped. The processor 234 uses one or more of the operational parameters received from the EMM 26 to detect whether or not the marine outboard engine 10 is currently running. A fuse 296, for example a 10-ampere fuse, may be connected between the switch 294 and one of the first and second power ports 286 and 290. The fuse is connected between the switch 294 and the first power port 286 in the non-limiting embodiment illustrated in FIG. 10.

Returning now to FIGS. 7 to 9, the control unit 232 and the communication ports 236, 238 and 240 are positioned within the recess 233 of the tiller 19. The cables 242 and 246 pass through a grommet 260 mounted to the tiller 19 so that they may connect the control unit 232 to EMM 26 of the marine outboard engine 10. Between the grommet 260 and the marine outboard engine 10, the cables 242 and 246 are received within a rigging bundle 262 (FIG. 1) that protects the cables 242 and 246.

Although some of the Figures show that the accessory cable 244 connected to the digital communication port 238 exits from the recess 233 of the tiller 19 via the grommet 260, an embodiment as illustrated on FIG. 9 shows that the accessory cable 244 may be tucked into the recess 233 of the tiller 19 when not in use. To this end, the tiller system 200 may further comprise a door 264, for example a rubber door, mountable to the tiller 19 and adapted for selectively providing access to the recess 233 and to the cable 244.

As illustrated on FIGS. 8 and 9, the door 264 is positioned on a lower side of the front portion 142 of the tiller 19. The control unit 232 is positioned in the recess 233, generally above the door 264. The multi-pin connector 248 and the connector 252 are positioned on a side of the control unit 232 that is oriented toward a front end of the tiller 19, where the speed input control 132, the tilt/trim control switch 130, the touch troll button 219, the gear shift control 134, the start/stop switch 129 and the cut-off switch 128 are located. The digital communication ports 236, 238 and 240 are positioned on an opposite side of the control unit 232 and are oriented toward the rear portion 144 of the tiller 19. The cables 242, 244 and 246 are respectively connected to the digital communication ports 236, 238 and 240. The grommet 260 is mounted on the lower side of the front portion 142, behind the door 264 and substantially at a point where the front and rear portions 142 and 144 of the tiller 19 are connected. The grommet 260 is generally placed underneath the position of the digital communication ports 236, 238 and 240 so that the cables 242 and 246 connected to those ports may easily be routed therethrough and then back under the rear end 144 of the tiller 19, toward the rigging bundle 262 (FIG. 1).

When the door 264 is closed, a tip of the accessory cable 244 where the connector 245 is located may securely rest within an internal compartment 266 on a forward end of the door 264. Opening the door 264 allows an operator to extract the end of the accessory cable 244 from the recess 233 and to connect the connector 245 of the accessory cable 244 to an engine diagnostic device such as an on-board diagnostic (OBD) tool or to an external device such as, for example, a gauge, a chart plotter, a digital display device, a tachometer, and the like. It is contemplated that an extension cable may be required between the cable 244 and the external device. Manually routing the end of the accessory cable 244 through the grommet 260, as shown for example on FIG. 7, to allow its connection to an external device simplifies installation and rigging thereof.

Figure 11A:
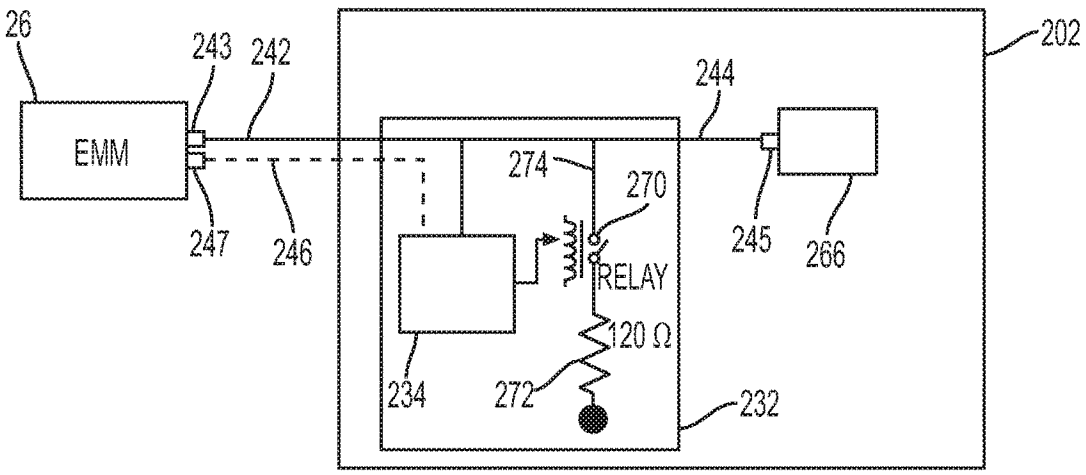
FIGS. 11*a* and 11*b* are schematic circuit diagrams illustrating a manner of connecting the control unit in a controller area network.
Figure 11B:
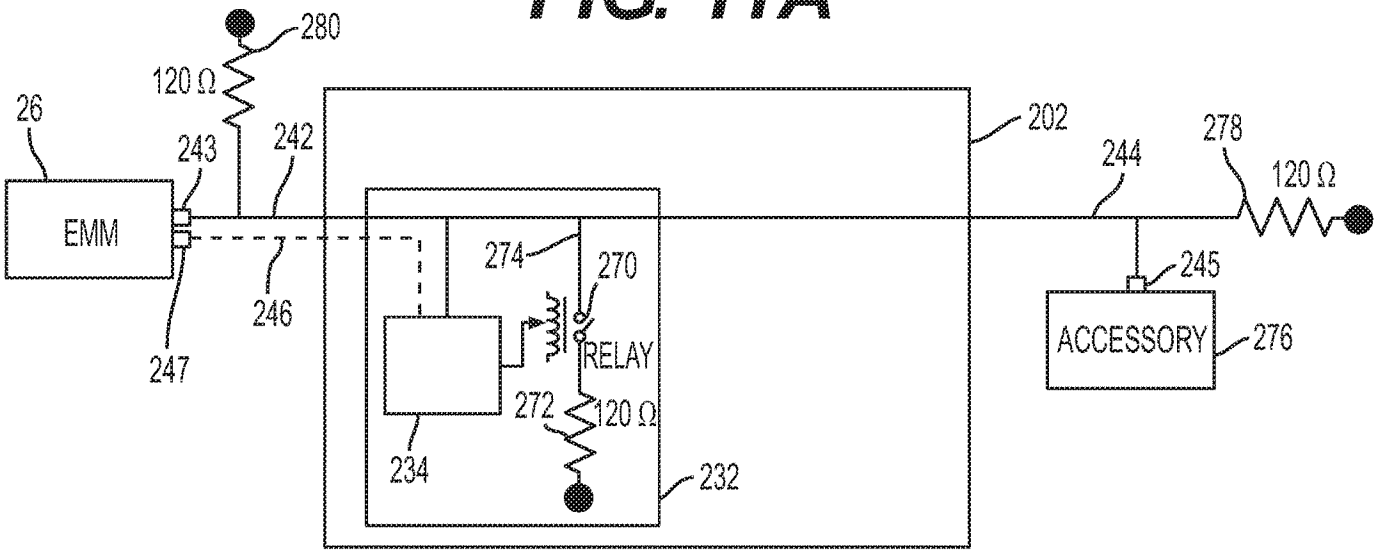

FIGS. 11*a* and 11*b* are schematic circuit diagrams illustrating a manner of connecting the control unit 232 of FIG. 10 in a controller area network. In order to comply with the NMEA 2000 protocol, each CAN bus should be terminated using a 200-ohm resistor. In a first configuration shown on FIG. 11*a*, the accessory cable 244 is not connected to any external device, the connector 245 of the accessory cable 244 securely resting within the internal compartment 266 of the door 264. The processor 234 causes the closing of a relay 270 to connect an internal 200-ohm resistor 272 at a junction 274 of the cables 242 and 244. In an embodiment, the relay 270, the internal 200-ohm resistor 272 and the junction 274 of the cables 242 and 244 are all located on the PCB of the control unit 232.

Turning now to FIG. 11*b*, the operator may connect an auxiliary device 276, for example a gauge, a chart plotter, a depth finder, a digital display device, or a tachometer to the CAN bus network via the accessory cable 244. An extension cable (not shown) may be connected between the accessory cable 244 and the auxiliary device 276. In order to maintain NMEA 2000 compliance, a first 200-ohm termination resistor 278 should be connected at the end of the NMEA 2000 backbone, for example using a T-connector (not shown) to connect at once the termination resistor 278 and the auxiliary device 276 to the accessory cable 244 (or to the extension cable, if used), and a second 200-ohm termination resistor 280 should be connected to the connector 243 of the cable 242, in close proximity to the EMM 26. At that time, the relay 270 may be opened via the processor 234 to disconnect the internal 200-ohm resistor 272 from the junction 274 of the cables 232 and 244.

Modifications and improvements to the above-described implementations of the present technology may become apparent to those skilled in the art. The foregoing description is intended to be exemplary rather than limiting.

The invention claimed is:

1. A tiller system for a marine outboard engine having a tiller bracket, the tiller system comprising:
- a tiller adapted for mounting to the tiller bracket;
- a speed input control mounted to the tiller;
- a speed input control position sensor adapted for detecting a position of the speed input control; and
- a control unit mounted to the tiller and operatively connected to the speed input control position sensor, the control unit being adapted for converting the position of the speed input control into a speed input message, the control unit comprising:
  - a first digital communication port adapted for transmitting the speed input message to the marine outboard engine over a controller area network (CAN) bus and for receiving, from the marine outboard engine over the CAN bus, a message carrying an operational parameter of the marine outboard engine, and
  - a second digital communication port adapted for outputting information related to the marine outboard engine over the CAN bus, the information being based at least in part on the operational parameter of the marine outboard engine.

2. The tiller system of claim 1, wherein the second digital communication port is a diagnostic port.

3. The tiller system of claim 1, wherein the first and second digital communication ports are interchangeable.

4. The tiller system of claim 1, wherein:
- the CAN bus supports a standard protocol.

5. The tiller system of claim 4, wherein the standard protocol is a National Marine Electronics Association (NMEA) 2000 protocol.

6. The tiller system of claim 4, wherein:
- the first communication port is adapted for using the standard protocol to control an operation of the marine outboard engine; and
- the second communication port is adapted for using the standard protocol to output the information.

7. The tiller system of claim 6, wherein the information is selected from a run/stop status of the marine outboard engine, an on/off status of an engine management module for the marine outboard engine, a rotational speed of the marine outboard engine, a temperature of the marine outboard engine, a transmission gear of the marine outboard engine, a battery voltage of the marine outboard engine, a tilt/trim position of the marine outboard engine, a fault code of the marine outboard engine, a low oil message, a lack of oil message, a fuel level, a coolant temperature, an engine overheat message, a check engine message, and any combination thereof.

8. The tiller system of claim 4, further comprising:

a first cable connected to the first digital communication port for providing a connection of the first digital communication port to the marine outboard engine; and a second cable connected to the second digital communication port, the second cable being adapted for selectively providing a connection between the marine outboard engine and the external device.

9. The tiller system of claim 8, wherein the first and second communication ports and the control unit are positioned within a recess of the tiller.

10. The tiller system of claim 9, further comprising a door mounted to the tiller and adapted for selectively providing access to the recess of the tiller and for allowing extraction of an end of the second cable from the recess.

11. The tiller system of claim 8, further comprising:

a third cable connected to a third digital communication port of the control unit for providing a connection of the third digital communication port to the marine outboard engine.

12. The tiller system of claim 11, wherein the third digital communication port is further adapted for communicating a wake-up message to the marine outboard engine.

13. The tiller system of claim 11, wherein the CAN bus is a first CAN bus and wherein the third communication port is further adapted for communicating with the marine outboard engine using a proprietary protocol over a second CAN bus.

14. The tiller system of claim 1, further comprising:

a first power cable having a first power connector at one end for connection to a battery of the marine outboard engine, another end of the first power cable being connected to a first power port of the control unit;

a second power cable being connected at one end to a second power port of the control unit, another end of the second power cable having a second power connector adapted for attachment to an auxiliary device; and a switch controlled by the control unit and adapted for establishing an electrical connection between the first and second power ports.

15. The tiller system of claim 14, wherein the control unit controls the switch when the control unit detects, based on the operational parameter of the marine outboard engine, that the marine outboard engine is running.

16. The tiller system of claim 1, further comprising:

a wire harness adapted for connecting the speed input control position sensor to the control unit.

17. The tiller system of claim 16, further comprising:

a display device mounted to the tiller;

wherein the first digital communication port is further adapted for receiving from the marine outboard engine a status message over the CAN bus; and the control unit is further adapted for converting the status message into a status to be displayed by the display device.

18. A marine outboard engine system for a watercraft, comprising:

an engine assembly, comprising:

an engine, a gear case, a driveshaft operatively connected at a first end to the engine and operatively connected at an opposite second end to the gear case, a propeller shaft driven by the engine via the driveshaft and the gear case, a propeller mounted to the propeller shaft, and an engine management module adapted for controlling the engine;

a bracket assembly adapted for connecting the engine assembly to the watercraft;

a tiller bracket mounted to the engine assembly; and the tiller system of claim 1 mounted to the tiller bracket, the first and second digital communication ports communicating with the engine management module.

* * * * *